US006091398A

United States Patent [19]

Shigeta

[11] Patent Number: 6,091,398

[45] Date of Patent: Jul. 18, 2000

[54] DRIVE APPARATUS FOR SELF LIGHT-EMITTING DISPLAY

[75] Inventor: Tetsuya Shigeta, Koufu, Japan

[73] Assignee: Pioneer Electronic Corporation, Tokyo, Japan

[21] Appl. No.: 08/927,528

[22] Filed: Sep. 11, 1997

[30] Foreign Application Priority Data

Sep. 20, 1996 [JP] Japan ..... 8-249635

[51] Int. Cl.[7] ..... G09G 5/10

[52] U.S. Cl. ..... 345/149; 345/204; 345/147; 395/109

[58] Field of Search ..... 345/204, 173, 345/147, 148, 149; 348/798, 472, 564; 358/444, 451; 395/109

[56] References Cited

U.S. PATENT DOCUMENTS

| | | | |
|---|---|---|---|
| 3,953,668 | 4/1976 | Judice | 178/6 |
| 4,377,821 | 3/1983 | Sautter | 348/472 |
| 4,686,332 | 8/1987 | Greanias | 345/173 |
| 5,287,209 | 2/1994 | Hiratsuka | 395/109 |
| 5,818,419 | 10/1998 | Tajima et al. | 345/147 |

FOREIGN PATENT DOCUMENTS

| | | | |
|---|---|---|---|
| 0 707 302 | 4/1996 | European Pat. Off. | G09G 3/28 |

OTHER PUBLICATIONS

Patent Abstracts of Japan; vol. 96, No. 2, Feb. 29, 1996 & JP 07 271325 A (Fujitsu Ltd.) Oct. 25, 1995 *Abstract.

*Primary Examiner*—Steven J. Saras
*Assistant Examiner*—Fritz Alphonse
*Attorney, Agent, or Firm*—Sughrue, Mion, Zinn, Macpeak & Seas, PLLC

[57] ABSTRACT

A drive apparatus for a self light-emitting display unit accomplishes pseudo intermediate tone display and pseudo outline compensation while maintaining a high image quality. In executing dithering-based pseudo intermediate tone display and pseudo outline compensation data conversion on pixel data corresponding to the individual pixels of the self light-emitting display unit, dither coefficients to be added to the individual pieces of pixel data are changed field by field in this dithering process. Furthermore, the pseudo outline compensation data conversion performed is associated with each dither coefficient added in the dithering process.

4 Claims, 16 Drawing Sheets

FIG.10

| LUMINANCE LEVEL | DITHERED PIXEL DATA Z | FIRST CONVERSION TABLE | SECOND CONVERSION TABLE |
|---|---|---|---|
| | BITS 5 — 0 | AZ BITS 7 — 0 | BZ BITS 7 — 0 |
| 0 | 000000 | 00000000 | 00000000 |
| 1 | 000001 | 00000100 | 00000100 |
| 2 | 000010 | 00100000 | 00100000 |
| 3 | 000011 | 00100100 | 00100100 |
| 4 | 000100 | 00001000 | 00001000 |
| 5 | 000101 | 00001100 | 00001100 |
| 6 | 000110 | 00101000 | 00101000 |
| 7 | 000111 | 00101100 | 00101100 |
| 8 | 001000 | 00010000 | 00010000 |
| 9 | 001001 | 00010100 | 00010100 |
| 10 | 001010 | 00110000 | 00110000 |
| 11 | 001011 | 00110100 | 00110100 |
| 12 | 001100 | 00011000 | 00011000 |
| 13 | 001101 | 00011100 | 00011100 |
| 14 | 001110 | 00111000 | 00111000 |
| 15 | 001111 | 00111100 | 00111100 |
| 16 | 010000 | 10010000 | 00010001 |
| 17 | 010001 | 10010100 | 00101001 |
| 18 | 010010 | 10110000 | 00110001 |
| 19 | 010011 | 10110100 | 00110101 |
| 20 | 010100 | 10011000 | 00011001 |
| 21 | 010101 | 10011100 | 00011101 |
| 22 | 010110 | 10111000 | 00111001 |
| 23 | 010111 | 10111100 | 00111101 |
| 24 | 011000 | 10010001 | 10010001 |
| 25 | 011001 | 10010101 | 10010101 |
| 26 | 011010 | 10110001 | 10110001 |
| 27 | 011011 | 10110101 | 10110101 |
| 28 | 011100 | 10011001 | 10011001 |
| 29 | 011101 | 10011101 | 10011101 |
| 30 | 011110 | 10111001 | 10111001 |
| 31 | 011111 | 10111101 | 10111101 |

FIG.11

| LUMINANCE LEVEL | DITHERED PIXEL DATA | FIRST CONVERSION TABLE | SECOND CONVERSION TABLE |
|---|---|---|---|
| | BITS 5 — 0 | AZ BITS 7 — 0 | BZ BITS 7 — 0 |
| 32 | 100000 | 01010001 | 10010010 |
| 33 | 100001 | 01010101 | 10010110 |
| 34 | 100010 | 01110001 | 10110010 |
| 35 | 100011 | 01110101 | 10110110 |
| 36 | 100100 | 01011001 | 10011010 |
| 37 | 100101 | 01011101 | 10011110 |
| 38 | 100110 | 01111001 | 10111010 |
| 39 | 100111 | 01111101 | 10111110 |
| 40 | 101000 | 01010010 | 01010010 |
| 41 | 101001 | 01010110 | 01010110 |
| 42 | 101010 | 01110010 | 01110010 |
| 43 | 101011 | 01110110 | 01110110 |
| 44 | 101100 | 01011010 | 01011010 |
| 45 | 101101 | 01011110 | 01011110 |
| 46 | 101110 | 01111010 | 01111010 |
| 47 | 101111 | 01111110 | 01111110 |
| 48 | 110000 | 11010010 | 01010011 |
| 49 | 110001 | 11010110 | 01010111 |
| 50 | 110010 | 11110010 | 01110011 |
| 51 | 110011 | 11110110 | 01110111 |
| 52 | 110100 | 11011010 | 01011011 |
| 53 | 110101 | 11011110 | 01011111 |
| 54 | 110110 | 11111010 | 01111011 |
| 55 | 110111 | 11111110 | 01111111 |
| 56 | 111000 | 11010011 | 11010011 |
| 57 | 111001 | 11010111 | 11010111 |
| 58 | 111010 | 11110011 | 11110011 |
| 59 | 111011 | 11110111 | 11110111 |
| 60 | 111100 | 11011011 | 11011011 |
| 61 | 111101 | 11011111 | 11011111 |
| 62 | 111110 | 11110111 | 11110111 |
| 63 | 111111 | 11111111 | 11111111 |

FIG.14A

FIRST FIELD

| | $G_{11}$ 1 | $G_{12}$ 2 |
|---|---|---|
| 1 | $Z(D_{11}+a)$ $=16$ | $Z(D_{12}+b)$ $=15$ |
| 2 | $Z(D_{11}+c)$ $=15$ | $Z(D_{12}+d)$ $=15$ |
| | $G_{21}$ | $G_{22}$ |

FIG.14B

SECOND FIELD

| | $G_{11}$ 1 | $G_{12}$ 2 |
|---|---|---|
| 1 | $Z(D_{21}+b)$ $=15$ | $Z(D_{22}+a)$ $=16$ |
| 2 | $Z(D_{21}+d)$ $=15$ | $Z(D_{22}+c)$ $=15$ |
| | $G_{21}$ | $G_{22}$ |

FIG.14C

THIRD FIELD

| | $G_{11}$ 1 | $G_{12}$ 2 |
|---|---|---|
| 1 | $Z(D_{11}+d)$ $=15$ | $Z(D_{12}+c)$ $=15$ |
| 2 | $Z(D_{11}+b)$ $=15$ | $Z(D_{12}+a)$ $=16$ |
| | $G_{21}$ | $G_{22}$ |

FIG.14D

FOURTH FIELD

| | $G_{11}$ 1 | $G_{12}$ 2 |
|---|---|---|
| 1 | $Z(D_{21}+c)$ $=15$ | $Z(D_{22}+d)$ $=15$ |
| 2 | $Z(D_{21}+a)$ $=16$ | $Z(D_{22}+b)$ $=15$ |
| | $G_{21}$ | $G_{22}$ |

FIRST FIELD
G11
G12
1
2 (COLUMN)
1
AZ (D11+a)
BZ (D12+b)
2
BZ (D11+c)
AZ (D12+d)
(ROW)
G21
G22

SECOND FIELD
G11
G12
1
2 (COLUMN)
1
AZ (D21+d)
BZ (D22+c)
2
BZ (D21+b)
AZ (D22+a)
(ROW)
G21
G22

THIRD FIELD
G11
G12
1
2 (COLUMN)
1
BZ (D11+b)
AZ (D12+a)
2
AZ (D11+d)
BZ (D12+c)
(ROW)
G21
G22

FOURTH FIELD
G11
G12
1
2 (COLUMN)
1
BZ (D21+c)
AZ (D22+d)
2
AZ (D21+a)
BZ (D22+b)
(ROW)
G21
G22

DRIVE APPARATUS FOR SELF LIGHT-EMITTING DISPLAY

BACKGROUND OF THE INVENTION

1. Field of the Invention

The present invention relates to a drive apparatus for a self light-emitting display.

2. Description of Related Art

To realize a gradation display on a plasma display panel as a self light-emitting display unit, there is a known method which divides the display period of one frame (field) into N subframes (subfields) to permit light emission only for the time corresponding to the weight on each bit position of N-bit display data (so-called subfield method).

When pixel data consists of eight bits, for example, the display period of one frame is divided into eight subframes SF8, SF7, SF6, . . . , and SF1 in the order of a heavier weight to a lighter one. At this time, light emissions of 128 pulses, 64 pulses, 32 pulses, 16 pulses, 8 pulses, 4 pulses, 2 pulses and 1 pulse are carried out in the respective subframes SF8 to SF1. The light emissions in those eight subframes provide 256-gradation display.

Because of the fixed display order for the subframes SF8–SF1, this gradation display scheme however has such a problem that a moire-like false outline which looks like a gradation-lost image is observed near the area on a flat image where the gradation level crosses the boundary of $2^n$ gradation levels, such as 128 or 64, which significantly degrades the display quality.

A gradation display scheme which solves this problem has been proposed in, for example, Japanese Patent Kokai (laying open) No. Hei 7-271325. This gradation display scheme suppresses a pseudo outline by equally dividing a subframe with a heavy weight into a plurality of subframes, separating them so as to prepare a plurality of light emission patterns which have the equal light emission time (the equal number of light emissions) with different light emission orders of the subframes, and changing the light emission pattern from one to another pixel by pixel (pseudo outline compensation data conversion).

This gradation display scheme however results in an increased number of subframes in one frame period. If the number of bits of pixel data is increased to improve the image quality, the number of subframes in one frame period is increased more.

The increase in the number of subframes in one frame period increases the addressing period for lighting a plasma display panel for light emission. This relatively shortens the sustain period as the light emission period, reducing the maximum luminescent.

In this respect, a dithering process which reduces the number of bits (the number of subframes) of pixel data and effects pseudo intermediate tone display is performed.

The dithering process expresses a single intermediate display level with a plurality of adjacent pixels. In the case where 8-bit equivalent gradation display is demonstrated using the upper six bits of pixel data in 8-bit pixel data, for example, four dither coefficients different from one another are respectively assigned to and added to pixel data corresponding to the individual pixels in each set of four pixels adjoining right and left and up and down are added to pixel data.

FIG. 1 is a diagram illustrating the correlation between dither coefficients "a" to "d" to be added to pixel data by this dithering process, and the individual pixels.

For example, the dither coefficient "a" is added to pixel data corresponding to the pixel at the first row and the first column, the dither coefficient "b" is added to pixel data corresponding to the pixel at the first row and the second column, the dither coefficient "c" is added to pixel data corresponding to the pixel at the second row and the first column, and the dither coefficient "d" is added to pixel data corresponding to the pixel at the second row and the second column.

Those dither coefficients "a" to "d" are respectively added to the pixel data of the individual pixels in each set of four pixels adjoining right and left and up and down are added to pixel data, as indicated by the broken lines in FIG. 1.

Then, the upper six bits of the dither-coefficients added pixel data are extracted to be used as a drive signal for the display panel.

This dithering process generates a combination of four different intermediate display levels with four pixels, thus ensuring four times the 6-bit gradation display levels or 8-bit equivalent intermediate tone display.

If the dither pattern consisting of the dither coefficients "a"–"d" is always added to the individual pixels as indicated by the broken lines in FIG. 1, however, noise originating from this dither pattern may appear, thus degrading the image quality.

SUMMARY OF THE INVENTION

Accordingly, it is an objective of the present invention to provide a drive apparatus for a self light-emitting display unit, which can accomplish pseudo intermediate tone display and pseudo outline compensation while maintaining a high image quality.

To achieve this object, a drive apparatus for a self light-emitting display unit according this invention comprises an A/D converter for sampling a video signal to convert the video signal to pixel data corresponding to individual pixels of the self light-emitting display unit; a dithering circuit for acquiring, as dithered pixel data, upper bits of each of dither-added pixel data obtained by adding different dither coefficients to the pixel data corresponding to a plurality of adjacent pixels on a screen of the self light-emitting display unit; a pseudo outline compensation data converter for converting the dithered pixel data based on a first conversion table and a second conversion table to yield pseudo outline compensation pixel data; and drive means for driving individual pixels of the self light-emitting display unit for light emission based on the pseudo outline compensation pixel data, whereby the dithering circuit changes the dither coefficients to be added to the pixel data corresponding to individual pixels for each field of the video signal.

BRIEF DESCRIPTION OF THE DRAWINGS

FIG. 10 is a diagram exemplifying first and second mode conversion tables in the pseudo outline compensation data converter 32;

FIG. 11 is a diagram further exemplifying first and second mode conversion tables in the pseudo outline compensation data converter 32;

FIGS. 14A through 14D are diagrams for explaining the operation at the time flickering occurs;

DETAILED DESCRIPTION OF THE PREFERRED EMBODIMENT

A preferred embodiment of the present invention will now be described with reference to FIGS. 2 through 17D.

Figure 1:
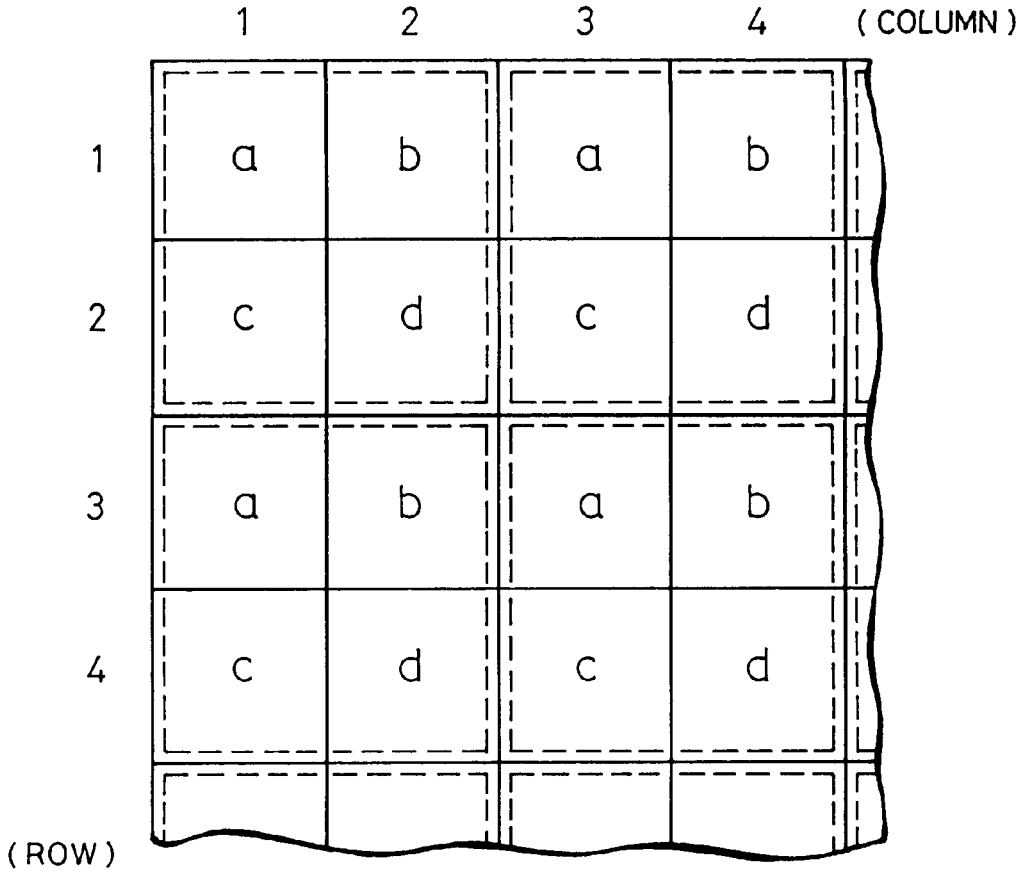
FIG. 1 is a diagram showing the states of dither coefficients to be added to associated pixels.
Figure 2:
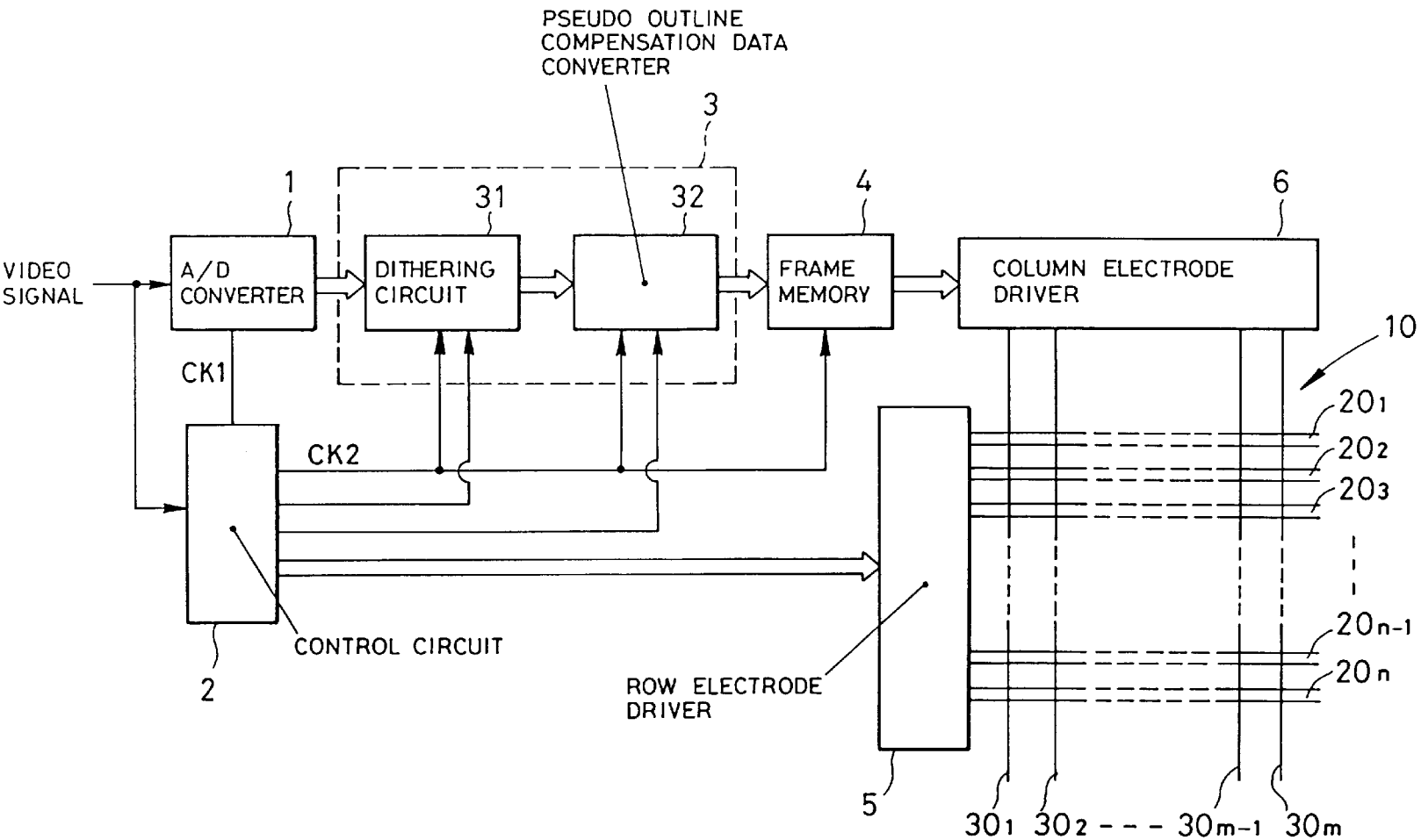
FIG. 2 is a diagram schematically illustrating the structure of a plasma display equipped with a drive apparatus according to this invention.

FIG. 2 is a diagram illustrating the schematic structure of a plasma display equipped with a drive apparatus according to this invention.

In FIG. 2, an A/D converter 1 samples an input video signal in accordance with a first clock signal CK1 of a frequency fs, supplied from a control circuit 2, to acquire N-bit pixel data D for each pixel and sequentially sends the pixel data D to an image data processor 3.

The image data processor 3 comprises a dithering circuit 31 for executing data processing in accordance with a second clock signal CK2 of a frequency 2·fs, horizontal and vertical sync signals and a select signal, supplied from the control circuit 2, and a pseudo outline compensation data converter 32.

Those dithering circuit 31 and pseudo outline compensation data converter 32 carry out processing (which will be discussed later) on the pixel data D to reduce the number of bits of pixel data to thereby accomplish pseudo intermediate tone display. The dithering circuit 31 and the pseudo outline compensation data converter 32 generate pseudo-outline compensated pixel data and supply the data to a frame memory 4.

The frame memory 4 sequentially writes the pixel data, sent from the image data processor 3, at every timing of the second clock signal CK2 from the control circuit 2. Further, the frame memory 4 reads the written pixel data at the timing of the second clock signal CK2 and sends it as pixel drive data to a column electrode driver 6.

The control circuit 2 generates the aforementioned first clock signal CK1 and second clock signal CK2. The control circuit 2 also generates a select signal which repeats the state of a logic value "1" and the state of a logic value "0" for each period of the first clock signal CK1, and sends this select signal to the pseudo outline compensation data converter 32. Further, the control circuit 2 extracts horizontal and vertical sync signals from the input video signal and supplies those signals to the dithering circuit 31. The control circuit 2 further generates a reset timing signal, a scan timing signal, a sustain timing signal and an erase timing signal according to the horizontal and vertical sync signals, and supplies those timing signals to a row electrode driver 5.

In accordance with those various timing signals, the row electrode driver 5 generates a reset pulse for initializing the amount of residual charges, a scan pulse for writing pixel data, a sustain pulse for sustaining the discharge light emission state and an erase pulse for stopping discharge light emission, and applies those pulses to pairs of row electrodes $\mathbf{20}_1$ to $\mathbf{20}_n$ of a PDP (Plasma Display Panel) 10. At this time, the scan pulse is sequentially applied to the pairs of row electrodes from $\mathbf{20}_1$ to $\mathbf{20}_n$.

The column electrode driver 6 separates one frame of pixel drive data read from the frame memory 4 for each of bits with the same weight, generates a pixel data pulse having a voltage value corresponding to a logic value "1" or "0" of that bit, and applies the pulse to column electrodes $\mathbf{30}_1$ to $\mathbf{30}_m$ of the PDP 10.

When the scan pulse is applied to the PDP 10 from the column electrode driver 5 while the pixel data pulse from the column electrode driver 6 is applied, a charge corresponding to the applied pixel data pulse is written in the PDP 10. At this time, light emission occurs at the intersection of a column electrode applied with the pixel data pulse corresponding to, for example, logic "1" and a row electrode pair applied with the scan pulse.

Figure 3:
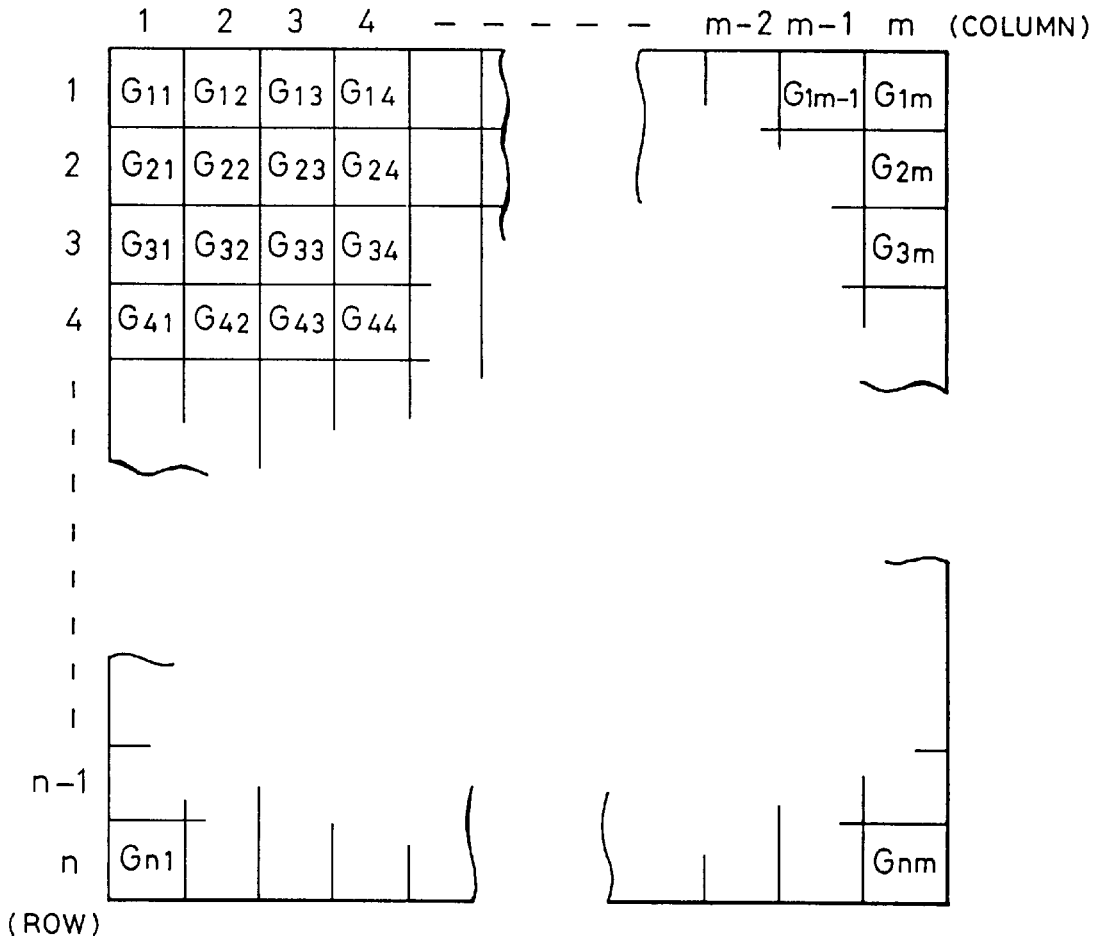
FIG. 3 is a diagram showing positions of individual pixels on a screen.

Each such intersection is equivalent to each of pixels $G_{11}$ to $G_{nm}$ on the screen of the PDP 10 as shown in FIG. 3.

When the sustain pulse is applied by the row electrode driver 5 thereafter, the light emission state is maintained for the time corresponding to the number of the sustain pulses applied. A viewer would visually sense the luminescence corresponding to the time for sustaining the light emission state.

The operation of the image data processor 3 will now be discussed with reference to the signal waveforms for the internal operation illustrated in FIGS. 4A–4H through FIGS. 7A–7H.

Figure 8:
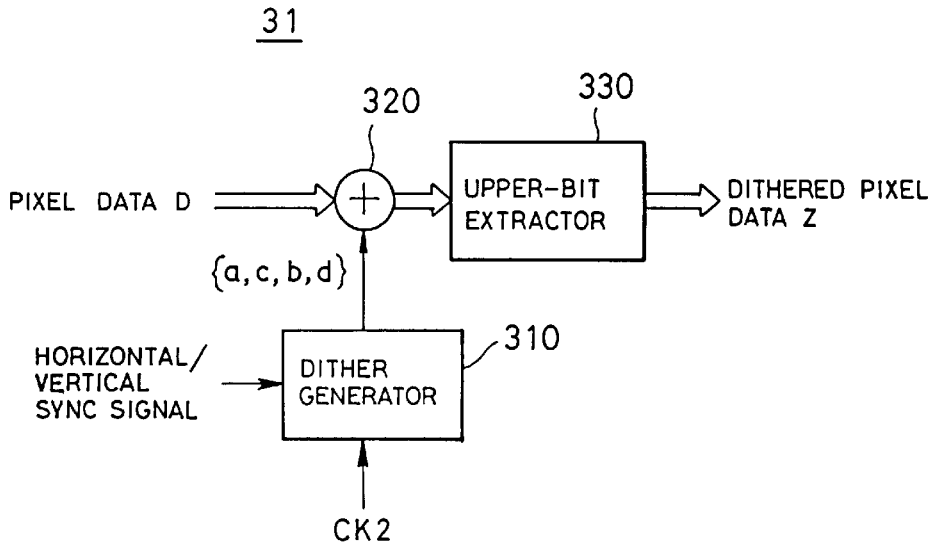
FIG. 8 is a diagram showing the internal structure of a dithering circuit 31.

FIG. 8 shows the internal structure of the dithering circuit 31 in the image data processor 3.

Referring to FIG. 8, N-bit pixel data D for each pixel corresponding to a video signal is sequentially supplied to an adder 320 for each first clock signal CK1. This video signal is what has been produced by skipped scanning. Therefore, pixel data corresponding to an odd row of pixels in the entire pixels of the PDP 10 shown in FIG. 3 are supplied first, and then pixel data corresponding to an even row of pixels are supplied.

Figures 4A, 4B, 4C, 4D, 4E, 4F, 4G, 4H:
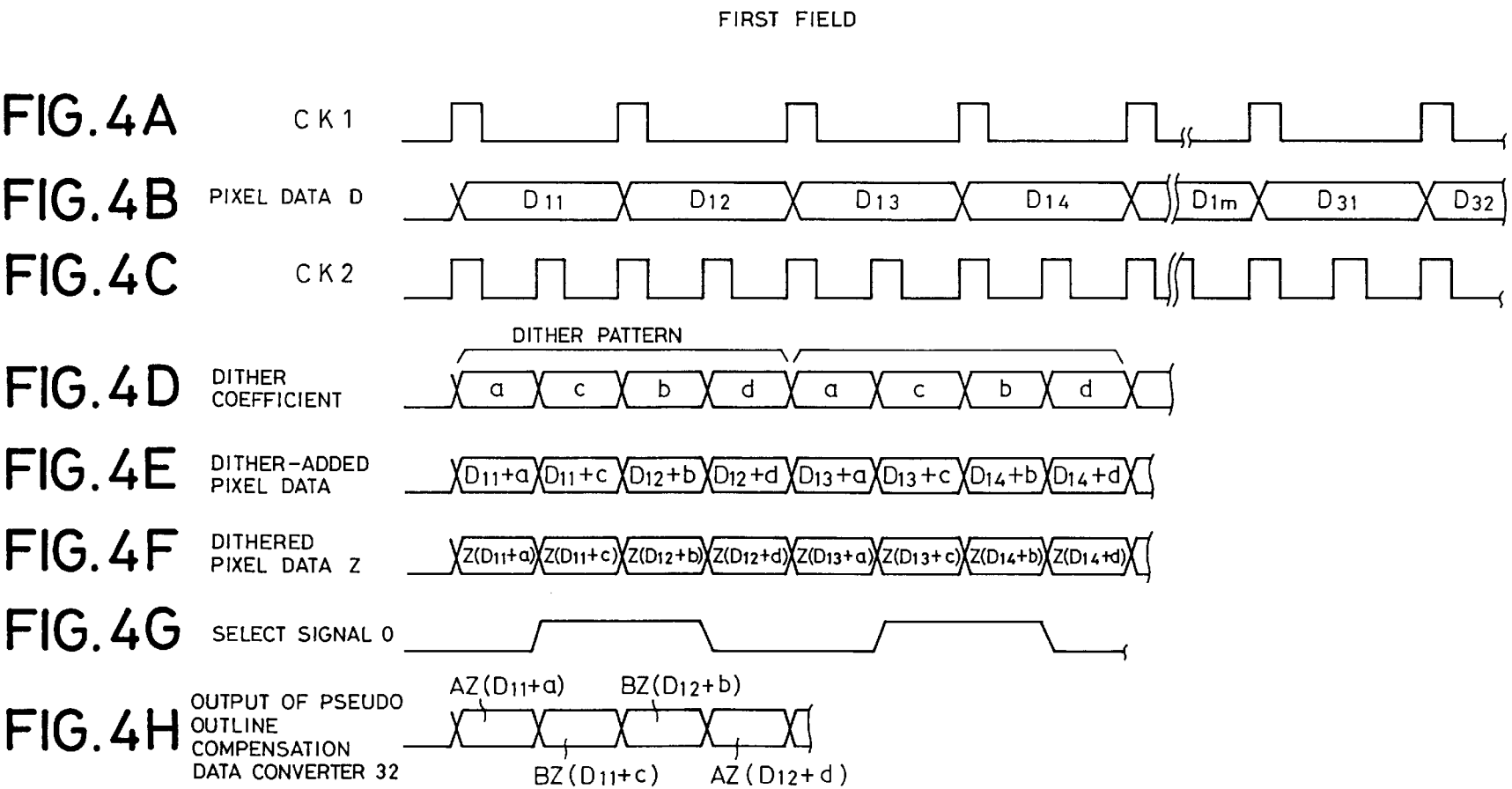
FIGS. 4A through 4H are diagrams illustrating signal waveforms for the internal operation of an image data processor 3 in the first field.
Figures 5A, 5B, 5C, 5D, 5E, 5F, 5G, 5H:
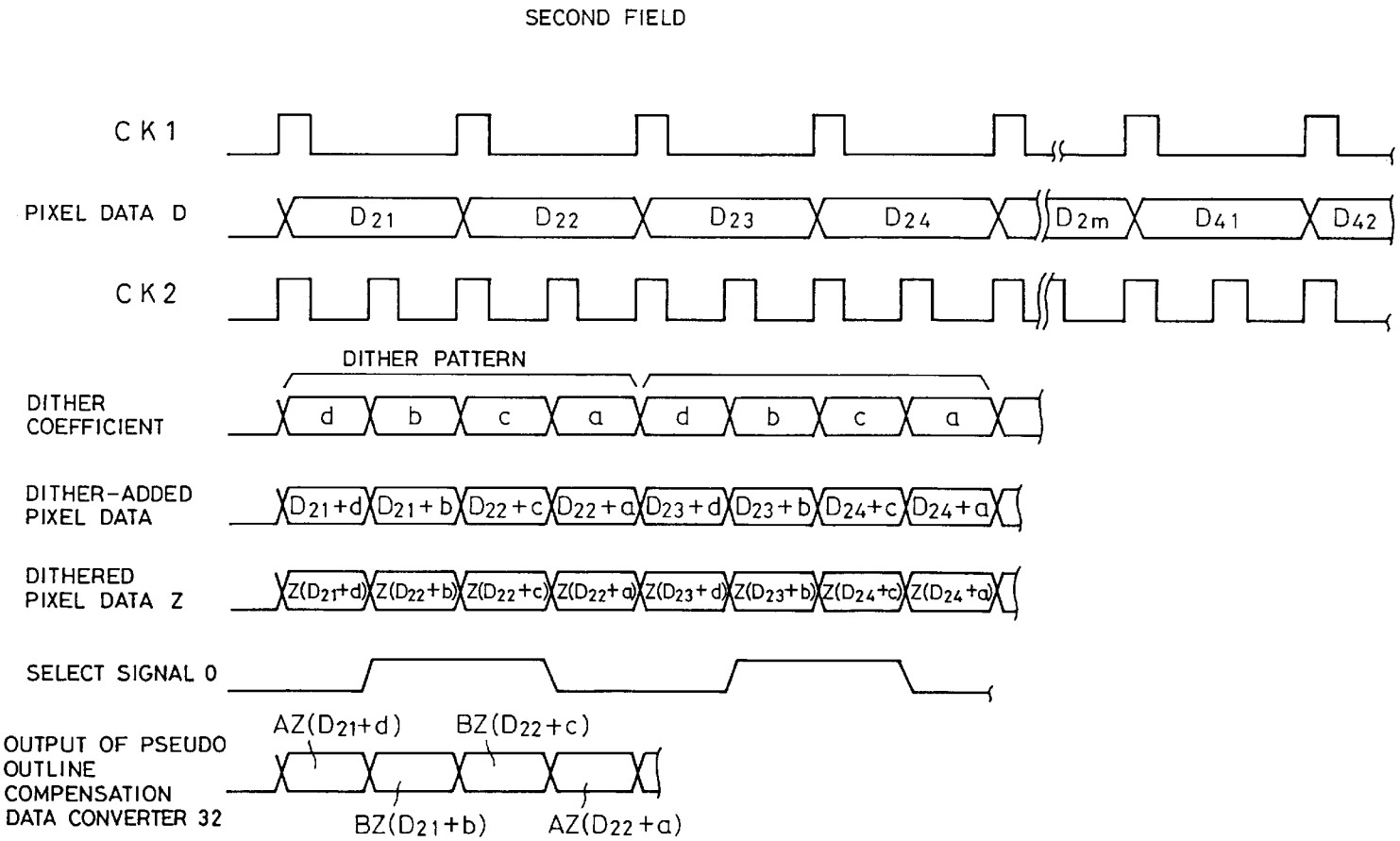
FIGS. 5A through 5H are diagrams illustrating signal waveforms for the internal operation of the image data processor 3 in the second field.
Figures 6A, 6B, 6C, 6D, 6E, 6F, 6G, 6H:
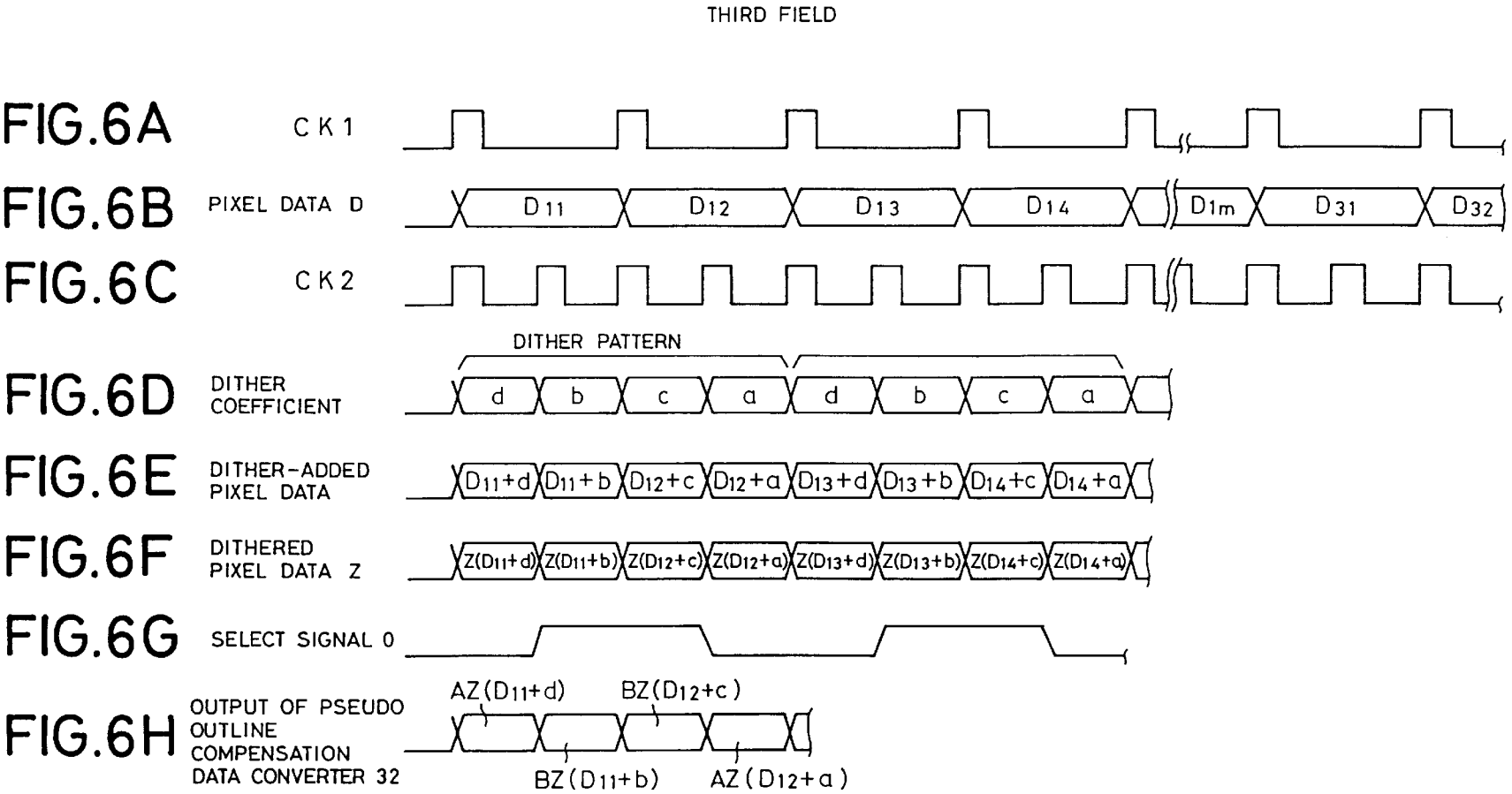
FIGS. 6A through 6H are diagrams illustrating signal waveforms for the internal operation of the image data processor 3 in the third field.

As shown in FIG. 4B, for example, after pixel data $D_{11}$–$D_{1m}$ respectively corresponding to the first row of pixels $G_{11}$–$G_{1m}$ in FIG. 3 are supplied, pixel data $D_{31}$–$D_{3m}$ respectively corresponding to the next odd row or the third row of pixels $G_{31}$–$G_{3m}$ are supplied. Likewise, pixel data corresponding to odd rows are sequentially supplied (first field). When pixel data $D_{n1}$–$D_{nm}$ respectively corresponding to the last odd row of pixels $G_{n1}$–$G_{nm}$ are supplied in the first field, pixel data $D_{21}$–$D_{2m}$ respectively corresponding to the first even row of pixels $G_{21}$–$G_{2m}$ are supplied after which pixel data corresponding to other even rows are sequentially supplied (second field), as shown in FIG. 5B. When pixel data $D_{(n-1)1}$–$D_{nm}$ respectively corresponding to the last even row are supplied in the second field, pixel data corresponding to odd rows are supplied again (third field) after which pixel data corresponding to even rows are supplied (fourth field).

Figures 7A, 7B, 7C, 7D, 7E, 7F, 7G, 7H:
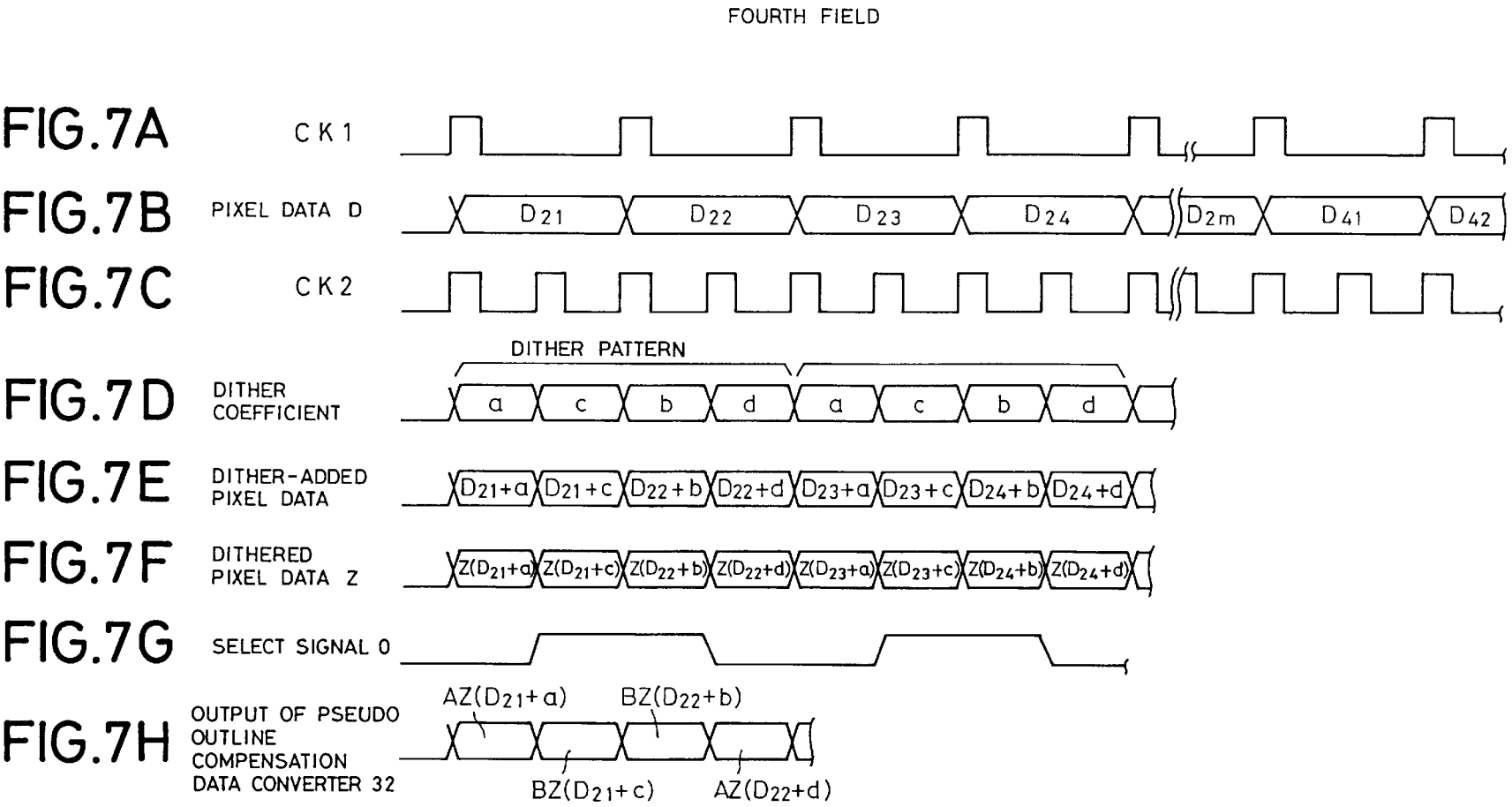
FIGS. 7A through 7H are diagrams illustrating signal waveforms for the internal operation of the image data processor 3 in the fourth field.

In the first field as shown in FIGS. 4C and 4D, a dither generator 310 repeatedly generates a dither coefficient a, dither coefficient "c", dither coefficient "b" and dither coefficient "d" in circulation for each second clock signal CK2, and supplies those dither coefficients to the adder 320. In the next second field and the subsequent third field, as shown in FIGS. 5C and 5D and FIGS. 6C and 6D, the dither generator 310 repeatedly generates the dither coefficient "d", dither coefficient "b", dither coefficient "c" and dither coefficient "a" in turn, and supplies those dither coefficients to the adder 320. In the fourth field, as shown in FIGS. 7C and 7D, the dither generator 310 repeatedly generates the dither coefficient "a", dither coefficient "c", dither coefficient "b" and dither coefficient "d" in circulation for each second clock signal CK2, and supplies those dither coefficients to the adder 320.

The dither generator 310 repeatedly executes the aforementioned operations in the first field to the fourth field. That is, when completing the operation for generating the dither coefficients in the fourth field, the dither generator 310 returns to the operation for the first field and repeats the aforementioned operations thereafter.

The adder 320 adds the aforementioned dither coefficients to the pixel data D sequentially supplied from the A/D converter 1 one by one as shown in FIGS. 4E, 5E, 6E and 7E, and sends the resultant dither-added pixel data to an upper-bit extractor 330.

In other words, two different dither coefficients are added to a single piece of pixel data to newly generate two pieces of dither-added pixel data.

The upper-bit extractor 330 extracts upper M bits of data of such dither-added pixel data and supplies the data as dithered pixel data Z to the pseudo outline compensation data converter 32 at the subsequent stage.

Figure 9:
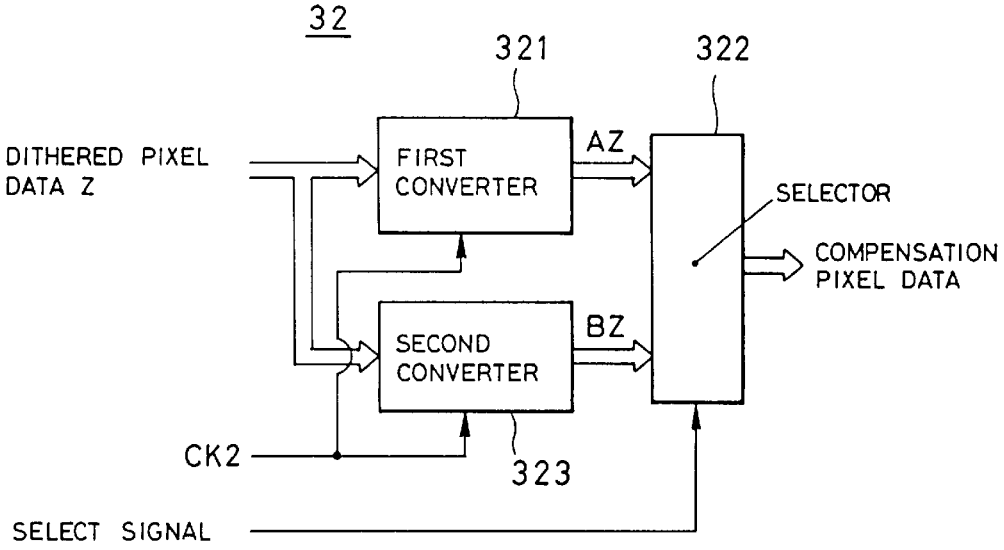
FIG. 9 is a diagram showing the internal structure of a pseudo outline compensation data converter 32.

FIG. 9 shows the internal structure of the pseudo outline compensation data converter 32.

In FIG. 9, a first converter 321 converts the dithered pixel data Z consisting of, for example, six bits supplied from the dithering circuit 31 to 8-bit pixel data based on a first mode conversion table as shown in FIG. 10 or 11, and supplies the converted data as pseudo outline compensation pixel data AZ to a selector 322. Meanwhile, a second converter 323 converts the dithered pixel data Z consisting of, for example, six bits supplied from the dithering circuit 31 to 8-bit pixel data based on a second mode conversion table as shown in FIG. 10 or 11, and supplies the converted data as pseudo outline compensation pixel data BZ to the selector 322.

The logic value "0" of each bit in the pseudo outline compensation pixel data AZ (BZ) shown in FIG. 10 or 11 designates no light emission while the logic value "1" designates light emission. The light emission period in one frame period accords to the light emission format in FIG. 12.

Figure 12:
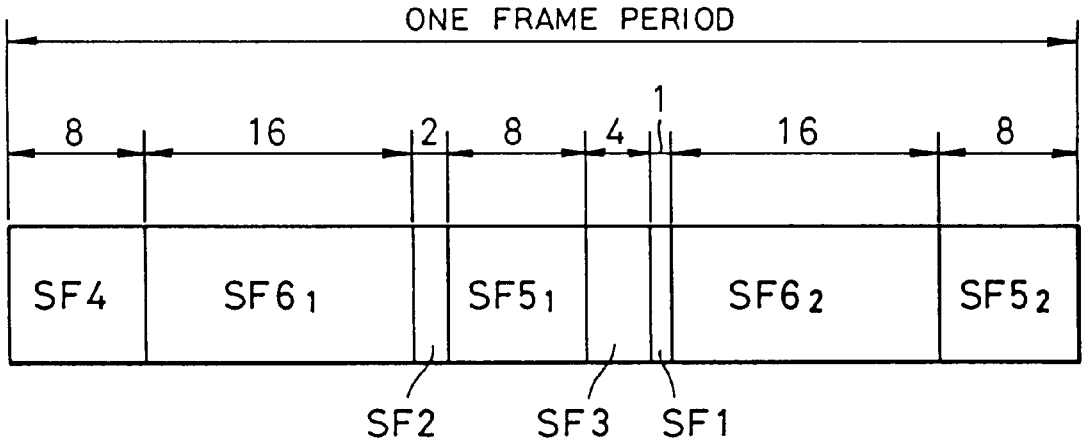
FIG. 12 is a diagram showing a light emission period format in terms of subframes.

For example, bit 7 of the pseudo outline compensation pixel data AZ corresponds to light emission in the subframe SF4 in FIG. 12, and when its logic value is "1", light emission is carried out for the period of "8". Bit 6 corresponds to light emission in the subframe SF$\mathbf{6}_1$, and when its logic value is "1", light emission is carried out for the period of "16". Bit 5 corresponds to light emission in the subframe SF2, and when its logic value is "1", light emission is carried out for the period of "2". Bit 4 corresponds to light emission in the subframe SF$\mathbf{5}_1$, and when its logic value is "1", light emission is carried out for the period of "8". Bit 3 corresponds to light emission in the subframe SF3, and when its logic value is "1", light emission is carried out for the period of "4". Bit 2 corresponds to light emission in the subframe SF1, and when its logic value is "1", light emission is carried out for the period of "1". Bit 1 corresponds to light emission in the subframe SF$\mathbf{6}_2$, and when its logic value is "1", light emission is carried out for the period of "16". Further, bit 0 corresponds to light emission in the subframe SF$\mathbf{5}_2$, and when its logic value is "1", light emission is carried out for the period of "8". The sum of the light emission periods in those SF1–SF6 is equivalent to the luminance level.

At this time, the subframe SF6 (equivalent to the light emission period of "32") which has a heavy weight is separated into the subframes SF$\mathbf{6}_1$ and SF$\mathbf{6}_2$ each specifying the light emission period of "16" and both arranged apart from each other. Further, the subframe SF5 (equivalent to the light emission period of "16") which also has a heavy weight is separated into the subframes SF$\mathbf{5}_1$ and SF$\mathbf{5}_2$ each specifying the light emission period of "8" and both arranged apart from each other. Two conversion patterns that have different light emission positions in subframes in one frame, whose total light emission periods are the same and whose light emission periods are equal to one another, are prepared in the first and second mode conversion tables to suppress a pseudo outline.

With regard to the pseudo outline compensation pixel data AZ equivalent to the luminance level 16 in FIGS. 10 and 11, for example, light emission for the period of "8" is carried out at the positions of the subframes SF4 and SF$\mathbf{5}_1$ shown in FIG. 12, while for the pseudo outline compensation pixel data BZ equivalent to the luminance level 16, light emission for the period of "8" is carried out at the positions of the subframes SF$\mathbf{5}_1$ and SF$\mathbf{5}_2$.

Even with the same luminance level, a pseudo outline can be suppressed by shifting the position of light emission in one frame period in the aforementioned manner. Data conversions by the first converter 321 and the second converter 323 are executed in synchronism with the second clock signal CK2.

The selector 322 selects one of the pseudo outline compensation pixel data AZ supplied from the first converter 321 and the pseudo outline compensation pixel data BZ supplied from the second converter 323 which accords to the logic value of a select signal, and sends out the selected one.

When the logic value of the select signal is "0" in FIGS. 4H, 5H, 6H and 7H, the selector 322 selects the pseudo outline compensation pixel data AZ supplied from the first converter 321 and sends it out. When the logic value of the select signal is "1", on the other hand, the selector 322 selects the pseudo outline compensation pixel data BZ supplied from the second converter 323 and sends it out.

The image data processor 3, as shown in FIGS. 4H, 5H, 6H and 7H, performs two different pixel data processes on a single piece of image-processed pixel data which have undergone the dithering process and pseudo outline compensation, and generate interpolated pixel data corresponding to another field different from the field for the supplied pixel data. In odd fields like the first and third fields, the above-described pixel data processing is executed based on the supplied pixel data corresponding to the odd fields, thereby generating interpolated pixel data corresponding to even fields. In even fields like the second and fourth fields, the above-described pixel data processing is executed based on the supplied pixel data corresponding to the even fields, thereby generating interpolated pixel data corresponding to odd fields.

In the first field as shown in FIGS. 4A through 4H, for example, two different dithering processes and pseudo outline compensations are performed on the pixel data $D_{11}$ at the first row and the first column to generate pseudo outline compensation pixel data $AZ(D_{11}+a)$ as image-processed pixel data corresponding to the pixel at the first row and the first column and generate pseudo outline compensation pixel data $BZ(D_{11}+c)$ as interpolated pixel data corresponding to the pixel at the second row and the first column. Further, two different dithering processes and pseudo outline compensations are performed on the pixel data $D_{12}$ at the first row and the second column to generate pseudo outline compensation pixel data $BZ(D_{12}+b)$ as image-processed pixel data corresponding to the pixel at the first row and the second column and generate pseudo outline compensation pixel data $AZ(D_{12}+d)$ as interpolated pixel data corresponding to the pixel at the second row and the second column.

Those image-processed pixel data and interpolated pixel data are sequentially written in the frame memory 4 in association with each of the first row to the n-th row of the screen of the PDP 10 as shown in FIG. 3. When pixel data of up to the n-th row or one frame of pixel data of one screen is written in the frame memory 4, the written pixel data is sequentially read from the frame memory 4 from the one associated with the first row and is supplied as pixel drive data to the column electrode driver 6.

Figures 13A, 13B, 13C, 13D:
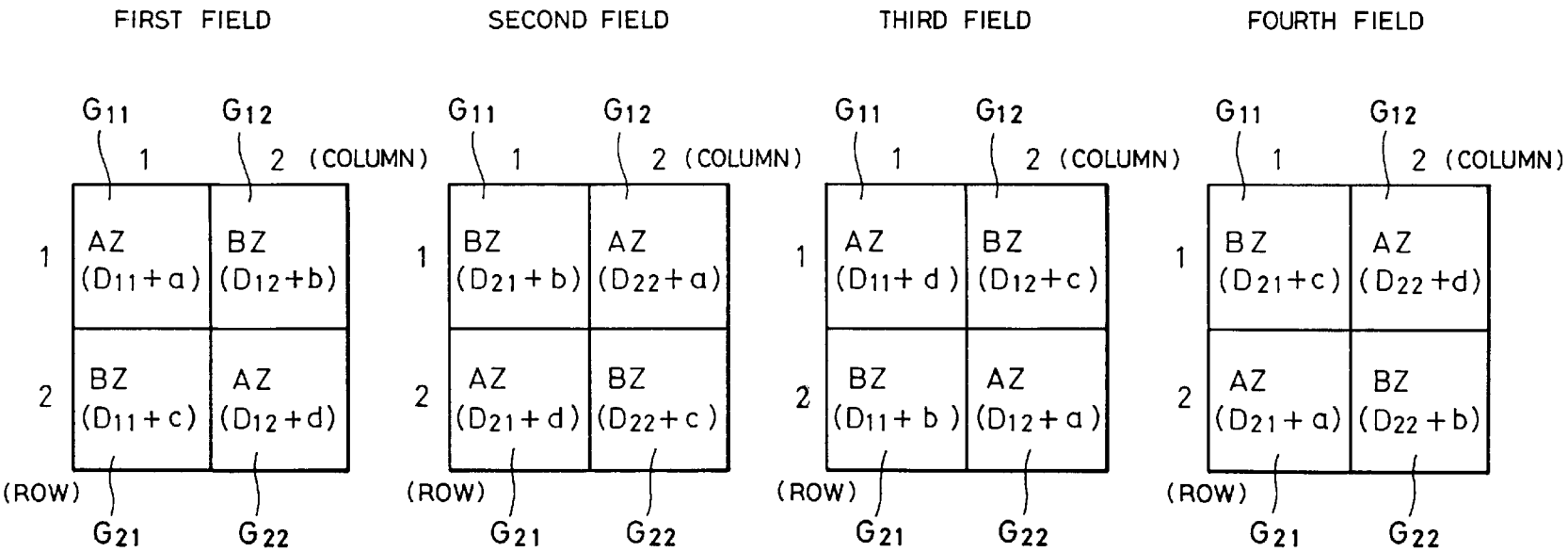
FIGS. 13A through 13D are diagrams exemplifying pseudo outline compensation pixel data generated by the image data processor 3 and illustrating the association of this pixel data with the individual pixels according to this invention.

The operation in the first field as shown in FIGS. 4A–4H causes light emission on the pixel $G_{11}$ at the first row and the first column based on the pseudo outline compensation pixel data $AZ(D_{11}+a)$, light emission on the pixel $G_{12}$ at the first row and the second column based on the pseudo outline compensation pixel data $BZ(D_{12}+b)$, light emission on the pixel $G_{21}$ at the second row and the first column based on the pseudo outline compensation pixel data $BZ(D_{11}+c)$, and light emission on the pixel $G_{22}$ at the second row and the second column based on the pseudo outline compensation pixel data $AZ(D_{12}+d)$ as shown in, for example, FIG. 13A.

In the second field as shown in FIGS. 5A through 5H, based on the pixel data $D_{21}$ at the second row and the first column, the image data processor 3 then generates pseudo outline compensation pixel data $AZ(D_{21}+d)$ as image-processed pixel data corresponding to this pixel at the second row and the first column, and generates pseudo outline compensation pixel data $BZ(D_{21}+b)$ as interpolated pixel data corresponding to the pixel at the first row and the first column. Based on the pixel data $D_{22}$ at the second row and the second column, the image data processor 3 generates pseudo outline compensation pixel data $BZ(D_{22}+c)$ as image-processed pixel data corresponding to this pixel at the second row and the second column, and generates pseudo outline compensation pixel data $AZ(D_{22}+a)$ as interpolated pixel data corresponding to the pixel at the first row and the second column.

Those image-processed pixel data and interpolated pixel data are sequentially written in the frame memory 4 in association with each of the first row to the n-th row of the screen of the PDP 10 as shown in FIG. 3. When pixel data of up to the n-th row or one frame of pixel data of one screen is written in the frame memory 4, the written pixel data is sequentially read from the frame memory 4 from the one associated with the first row and is supplied as pixel drive data to the column electrode driver 6.

The operation in the second field as shown in FIGS. 5A–5H causes light emission on the pixel $G_{11}$ at the first row and the first column based on the pseudo outline compensation pixel data $BZ(D_{21}+b)$, light emission on the pixel $G_{12}$ at the first row and the second column based on the pseudo outline compensation pixel data $AZ(D_{22}+a)$, light emission on the pixel $G_{21}$ at the second row and the first column based on the pseudo outline compensation pixel data $AZ(D_{21}+d)$, and light emission on the pixel $G_{22}$ at the second row and the second column based on the pseudo outline compensation pixel data $BZ(D_{22}+c)$ as shown in, for example, FIG. 13B.

In the third field as shown in FIGS. 6A through 6H, based on the pixel data $D_{11}$ at the first row and the first column, the image data processor 3 then generates pseudo outline compensation pixel data $AZ(D_{11}+d)$ as image-processed pixel data corresponding to this pixel at the first row and the first column, and generates pseudo outline compensation pixel data $BZ(D_{11}+b)$ as interpolated pixel data corresponding to the pixel at the second row and the first column. Based on the pixel data $D_{12}$ at the first row and the second column, the image data processor 3 generates pseudo outline compensation pixel data $BZ(D_{12}+c)$ as image-processed pixel data corresponding to this pixel at the first row and the second column, and generates pseudo outline compensation pixel data $AZ(D_{12}+a)$ as interpolated pixel data corresponding to the pixel at the second row and the second column.

Those image-processed pixel data and interpolated pixel data are sequentially written in the frame memory 4 in association with each of the first row to the n-th row of the screen of the PDP 10 as shown in FIG. 3. When pixel data of up to the n-th row or one frame of pixel data of one screen is written in the frame memory 4, the written pixel data is sequentially read from the frame memory 4 from the one associated with the first row and is supplied as pixel drive data to the column electrode driver 6.

The operation in the third field as shown in FIGS. 6A–6H causes light emission on the pixel $G_{11}$ at the first row and the first column based on the pseudo outline compensation pixel data $AZ(D_{11}+d)$, light emission on the pixel $G_{12}$ at the first row and the second column based on the pseudo outline compensation pixel data $BZ(D_{12}+c)$, light emission on the pixel $G_{21}$ at the second row and the first column based on the pseudo outline compensation pixel data $BZ(D_{11}+b)$, and light emission on the pixel $G_{22}$ at the second row and the second column based on the pseudo outline compensation pixel data $AZ(D_{12}+a)$ as shown in, for example, FIG. 13C.

In the fourth field as shown in FIGS. 7A through 7H, based on the pixel data $D_{21}$ at the second row and the first column, the image data processor 3 then generates pseudo outline compensation pixel data $AZ(D_{21}+a)$ as image-processed pixel data corresponding to this pixel at the second row and the first column, and generates pseudo outline compensation pixel data $BZ(D_{21}+c)$ as interpolated pixel data corresponding to the pixel at the first row and the first column. Based on the pixel data $D_{22}$ at the second row and the second column, the image data processor 3 generates pseudo outline compensation pixel data $BZ(D_{22}+b)$ as image-processed pixel data corresponding to this pixel at the second row and the second column, and generates pseudo outline compensation pixel data $AZ(D_{22}+d)$ as interpolated pixel data corresponding to the pixel at the first row and the second column.

Those image-processed pixel data and interpolated pixel data are sequentially written in the frame memory 4 in association with each of the first row to the n-th row of the screen of the PDP 10 as shown in FIG. 3. When pixel data of up to the n-th row or one frame of pixel data of one screen is written in the frame memory 4, the written pixel data is sequentially read from the frame memory 4 from the one associated with the first row and is supplied as pixel drive data to the column electrode driver 6.

The operation in the fourth field as shown in FIGS. 7A–7H causes light emission on the pixel $G_{11}$ at the first row and the first column based on the pseudo outline compensation pixel data $BZ(D_{21}+c)$, light emission on the pixel $G_{12}$ at the first row and the second column based on the pseudo outline compensation pixel data $AZ(D_{22}+d)$, light emission on the pixel $G_{21}$ at the second row and the first column based on the pseudo outline compensation pixel data $AZ(D_{21}+a)$, and light emission on the pixel $G_{22}$ at the second row and the second column based on the pseudo outline compensation pixel data $BZ(D_{22}+b)$ as shown in, for example, FIG. 13D.

As discussed above, the drive apparatus for a self light-emitting display unit according to this invention changes the dither coefficients to be added to pixel data corresponding to the individual pixels, field by field, as shown in FIGS. 13A–13D.

As shown in FIGS. 13A–13D, for example, the dither coefficient to be added to the pixel data $D_{11}$ corresponding to the pixel $G_{11}$ is changed field by field as follows:

First field: dither coefficient "a"

Second field: dither coefficient "b"

Third field: dither coefficient "d"

Fourth field: dither coefficient "c"

As the dither coefficients to be added are changed field by field in this manner, the noise of the dither pattern is suppressed by the integration effect.

Further, the dither coefficients to be added are associated with the converting operation by the pseudo outline compensation data converter 32 in this invention.

In FIGS. 13A–13D, for example, when the dither coefficient a or the dither coefficient d is added to pixel data D by the dithering circuit 31, the pseudo outline compensation data converter 32 performs conversion based on the first mode conversion table and sends out pseudo outline compensation pixel data AZ. When the dither coefficient b or the dither coefficient c is added to the pixel data D, on the other hand, the pseudo outline compensation data converter 32 performs conversion based on the second mode conversion table and sends out pseudo outline compensation pixel data BZ.

Such conversion is executed to prevent the occurrence of flickering which would occur when the dither coefficients to be added are changed field by field.

In other words, at the time the dither coefficients to be added are changed field by field as shown in FIGS. 13A–13D, light emitting states between fields do not become uniform, causing flickering, unless the dither coefficients to be added are associated with the converting operation by the pseudo outline compensation data converter 32.

Suppose that, as shown in FIGS. 14A–14D, the value of the dithered pixel data Z obtained by adding the dither coefficient "a" to the pixel data D becomes "16" and the value of the dithered pixel data Z obtained by adding any one of the other dither coefficients "b"–"d" to the pixel data D becomes "15" over the first to fourth fields.

In this case, the values of the dithered pixel data Z at the pixel $G_{11}$ in the first field, the pixel $G_{12}$ in the second field, the pixel $G_{22}$ in the third field and the pixel $G_{21}$ in the fourth field become "16".

The value "16" of the dithered pixel data Z is converted in the first and third fields using the first mode conversion table shown in FIG. 10 and is converted in the second and fourth fields using the second mode conversion table.

As a result, the following pseudo outline compensation pixel data are acquired.

First field: {10010000}

Second field: {00010001}

Third field: {10010000}

Fourth field: {00010001}

Figure 15:
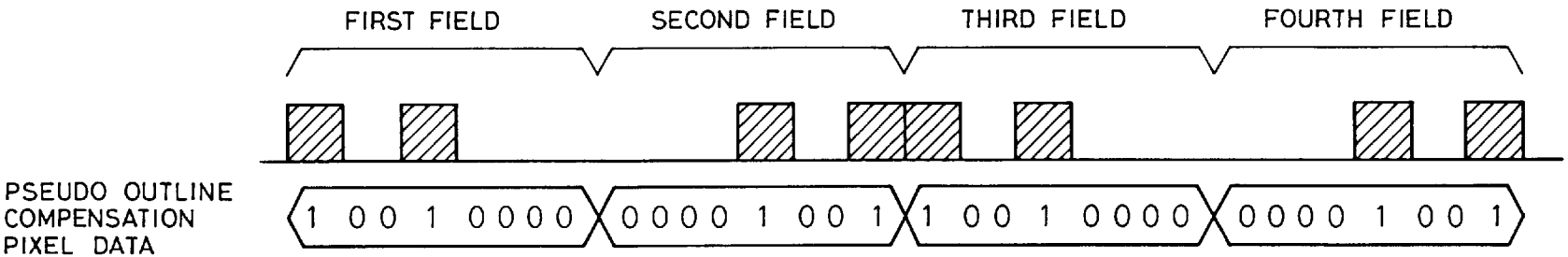
FIG. 15 is a diagram exemplifying the light emission state when flickering occurs.

FIG. 15 is a diagram showing the light emission state which occurs based on such pseudo outline compensation pixel data.

In FIG. 15, the shaded portions indicate the light emission state and blank portions indicate the non-light emission state. As apparent from FIG. 15, the non-light emission state continues between the first field and the second field, and the light emission state continues between the second field and the third field. When the light emission state between fields do not become uniform, flickering may occur.

According to this invention, such flickering is prevented by associating the dither coefficients to be added with the converting operation by the pseudo outline compensation data converter 32.

When the dither coefficient a is to be added as shown in FIGS. 13A–13D, for example, the pseudo outline compensation data converter 32 carries out conversion in any of the first to fourth fields by using the first mode conversion table.

In any of the first to fourth fields at this time, therefore, pseudo outline compensation pixel data {10010000} is obtained.

Figure 16:
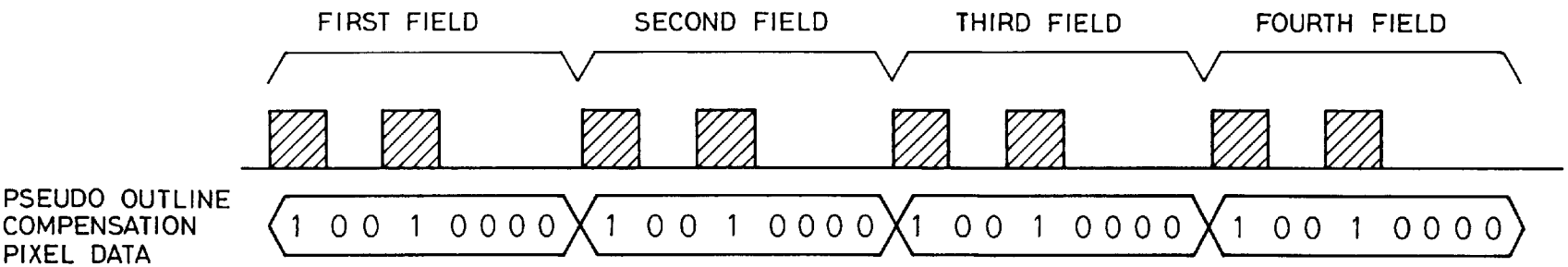
FIG. 16 is a diagram exemplifying the light emission state according to this invention.
Figures 17A, 17B, 17C, 17D:
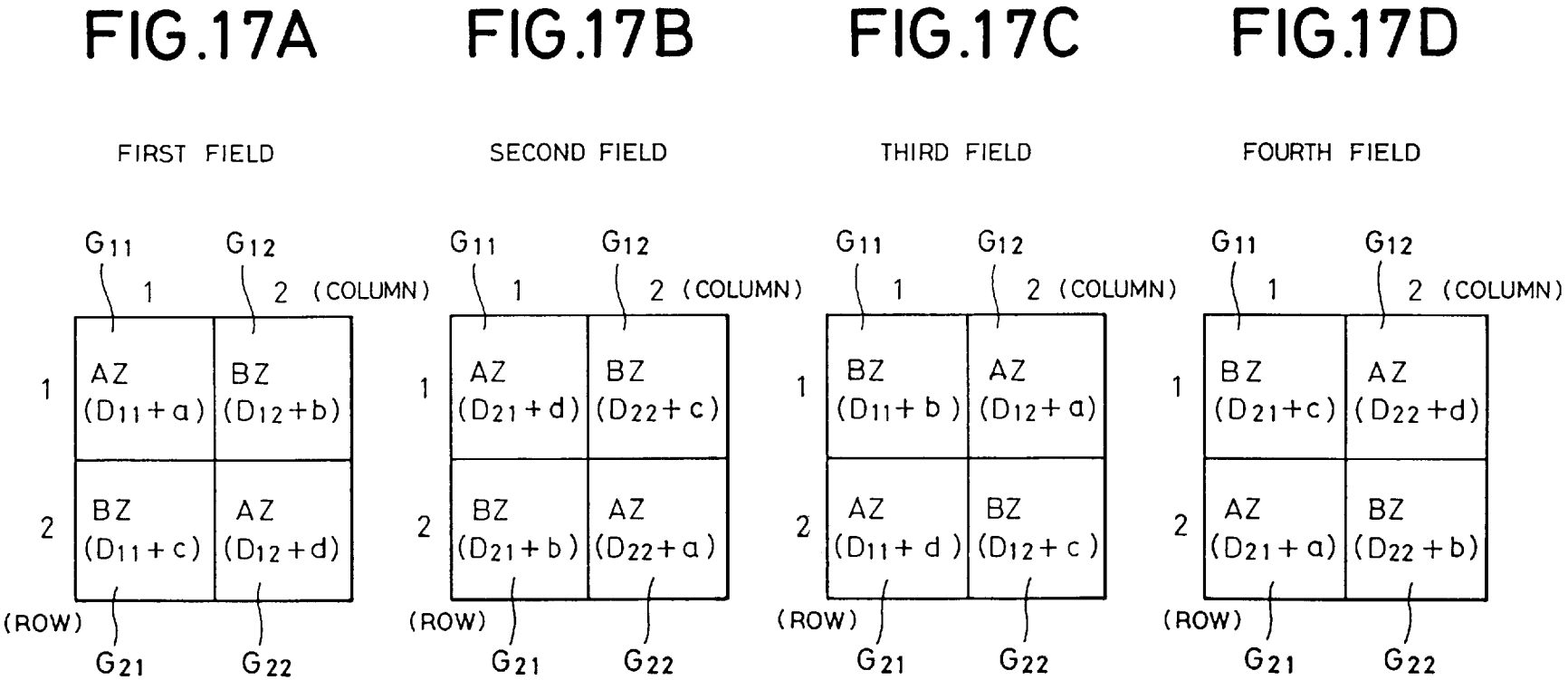
FIGS. 17A through 17D are diagrams showing another example of pseudo outline compensation pixel data generated by the image data processor 3 and illustrating the association of this pixel data with the individual pixels according to this invention.

FIG. 16 is a diagram exemplifying the light emission state which occurs based on this pseudo outline compensation pixel data.

Since the light emission state between fields become uniform as shown in FIG. 16 according to this invention, the aforementioned flickering does not occur.

Although the dithering circuit 31 in the above-described embodiment changes the dither coefficients to be added field by field as shown in FIGS. 13A–13D, this circuit is not limited to this particular structure. For example, the dithering circuit 31 may be designed to alter the dither coefficients "a"–"d" field by field as shown in FIGS. 17A–17D. In the modification illustrated in FIGS. 17A–17D, the pseudo outline compensation data converter 32 should perform pseudo outline compensation data conversion in association with the dither coefficients added by the dithering circuit 31 in order to prevent the aforementioned flickering.

As apparent from the foregoing description, the drive apparatus according to this invention changes dither coefficients to be added to the individual pieces of pixel data, field by field, at the time of executing dithering-based pseudo intermediate tone display and pseudo outline compensation data conversion on pixel data corresponding to the individual pixels of a self light-emitting display unit. Further, the pseudo outline compensation data conversion is performed in association with the dither coefficients added in the dithering process.

Therefore, this invention can accomplish pseudo intermediate tone display and pseudo outline compensation while preventing noise from being generated by a dither pattern and maintaining a high image quality.

What is claimed is:

1. A self light-emitting display unit comprising:

an A/D converter for sampling a video signal to convert said video signal to pixel data corresponding to individual pixels of said self light-emitting display unit;

a dithering circuit for acquiring, as dithered pixel data, upper bits of each of dither-added pixel data obtained by adding first and second sets of dither coefficients to said pixel data corresponding to a plurality of adjacent pixels on a screen of said self light-emitting display unit;

a pseudo outline compensation data converter for converting said dithered pixel data based on a first conversion table and a second conversion table to yield pseudo outline compensation pixel data; and drive means for driving individual pixels of said self light-emitting display unit for light emission based on said pseudo outline compensation pixel data, wherein said dithering circuit changes said dither coefficients to be added to said pixel data corresponding to individual pixels for each field of said video signal, and wherein said pseudo outline compensation data converter uses said first conversion table for converting said dithered pixel data acquired by using said dither-added pixel data obtained by adding said first set of dither coefficients and uses said second conversion table for converting said dithered pixel data acquired by using said dither-added pixel data obtained by adding said second set of dither coefficients.

2. The drive apparatus according to claim 1, wherein said drive means divides one frame to a plurality of subframes having light emission periods corresponding to individual bit positions of pixel drive data, further divides a subframe corresponding to a bit position with a heavy weight into a plurality of subframes, and causes pixels of said self light-emitting display unit to emit light only in those subframes associated with said pixel drive data; and each of said first and second conversion tables is a conversion pattern for converting a bit pattern of said pseudo outline compensation pixel data in such a manner that light emission positions in subframes having an equal light emission period become different from one another.

3. The drive apparatus according to claim 1, wherein said drive means divides one frame to a plurality of subframes having light emission periods corresponding to individual bit positions of pixel drive data, further divides a subframe corresponding to a bit position with a heavy weight into a plurality of subframes, and causes pixels of said self light-emitting display unit to emit light only in those subframes associated with said pixel drive data; and each of said first and second conversion tables is a conversion pattern for converting a bit pattern of said pseudo outline compensation pixel data in such a manner that light emission positions in subframes having an equal light emission period become different from one another.

4. The drive apparatus according to claim 1, wherein said dithering circuit respectively adds a first dither coefficient, a second dither coefficient, a third dither coefficient and a fourth dither coefficient to four pieces of pixel data respectively corresponding to four adjoining pixels on said screen of said self light-emitting display unit, and alters a combination of said first dither coefficient, said second dither coefficient, said third dither coefficient and said fourth dither coefficient to be respectively added to said four pieces of pixel data for each field of said video signal.

* * * * *